United States Patent [19]

DeMone et al.

[11] Patent Number: 5,033,075

[45] Date of Patent: Jul. 16, 1991

[54] RADIATION REDUCTION FILTER FOR USE IN MEDICAL DIAGNOSIS

[75] Inventors: Kenneth E. DeMone, Oakville; Earl J. McCutcheon, Guelph, both of Canada

[73] Assignee: Rad/Red Laboratories Inc., Oakville, Canada

[21] Appl. No.: 310,614

[22] Filed: Feb. 15, 1989

Related U.S. Application Data

[63] Continuation-in-part of Ser. No. 195,645, May 18, 1988, abandoned.

[51] Int. Cl.[5] ..... G21K 3/00

[52] U.S. Cl. ..... 378/156; 378/158

[58] Field of Search ..... 378/156, 158

[56] References Cited

U.S. PATENT DOCUMENTS 3,515,874 6/1970 Bens et al. ..... 378/156

4,499,591 2/1985 Hartwell ..... 378/156

*Primary Examiner*—Edward P. Westin

*Assistant Examiner*—David P. Porta

[57] ABSTRACT

In accordance with the present invention, there is provided an X-ray filter which significantly reduces low energy radiation normally absorbed by the examination object without significantly affecting the desired high energy radiation. The filter is comprised of one or more materials containing as the major component elements selected from the group consisting of aluminum and elements having atomic numbers between 26 and 50 with the filter being selected to have X-ray filtering characteristics such that the intensity of X-rays having energies of 50 keV are reduced by about 8% to about 35% of the normal radiation levels. As a result of the construction immediately above, the filter of the present invention filters energy from the X-ray beam which is usually absorbed by the examination object and does not contribute to the radiographic image of the examination object. This is achieved with little, if any, increased loading of the X-ray tube which would otherwise reduce its effective life.

6 Claims, 2 Drawing Sheets

RADIATION REDUCTION FILTER FOR USE IN MEDICAL DIAGNOSIS

This is a Continuation-In-Part application of-U.S. Pat. application S.N. 07/195,645, filed May 18, 1988 now abandoned.

FIELD OF THE INVENTION

This invention relates to X-ray radiography and fluoroscopy and particularly to filters for limiting the radiation dosage to a patient exposed to X-rays during medical and dental diagnosis.

BACKGROUND OF THE INVENTION

X-rays are produced in an X-ray tube as a result of high speed electrons striking a target material. The electrons strike and penetrate the surface layers of the target material and through interaction or collision with the atoms of the target, the energy of the electron is imparted to the electrons in the target.

If, in striking the target, the energy of the electron is dissipated through a series of collisions with the outer electrons of the target atoms, then the energy is released either in the form of heat or as visible light. An electron may, after a series of collisions, also emerge from the target as a back-scattered electron. These collisions result in most of the energy losses contributing to target heating and hence reduced X-ray tube life.

The electron may also have radiative collisions, giving up part or sometimes all of its energy to photons. The photons produced as a result of these collisions have an energy less than or equal to the energy given up by the electron.

If the energy of the electron is sufficient to collide with and eject an electron from the inner K-shell of the target atom, then the excited target atom, when the electrons in the outer shells drop into the vacant inner shell, will return to its ground state and a photon will be emitted. The energies of these transitions are dependent upon the atoms comprising the target material and hence the energies of the photons emitted are characteristic of the target atom. This radiation is known in the art as the characteristic X-ray radiation and is produced by the X-ray tube only when the energy of the electron striking the target is above the level required to dislodge the K-electron of the target atom.

The energy of the photon comprising the X-ray is directly related to the energy given up by the electron in the collision with the target molecules. As it is well known that the relationship between the wavelength ($\lambda$) of a photon and its energy is expressed by the Duane-Hunt equation:

$$\lambda = \frac{12.4}{keV} A^{\circ}$$

this process results in X-rays of various wavelengths which constitute what is known in the art as the continuous X-ray spectrum.

The ability of the X-rays to penetrate an examination object depends on the wavelength or energy of the X-ray photons as well as the composition of the examination object - i,e. its chemical elements, thickness and density. With respect to the wavelength or energy of the X-rays, generally the penetration ability is inversely proportional to wavelength or directly proportional to energy. Thus, short wavelength (high energy) X-rays have a greater penetrating ability than long wavelength (low energy) X-rays. With respect to the chemical elements making up the examination object, generally, the higher the atomic number of the element, the less the penetration of the X-ray beam. However, at wavelengths or energy levels near the absorption edges of the elements, these generalizations do not hold true as there are discontinuities in the degree of absorption of the X-ray beam at these points. With respect to the thickness and density of an examination object, generally, the thicker and denser the object the greater its ability to absorb X-rays and thus fewer X-rays pass through the object. It is the combination of these factors as they relate to different compositions of material which allows for the differential diagnosis of radiography. Thus, the selection of the operating parameters of the X-ray apparatus during medical diagnosis depends upon the examination object, its chemical composition, thickness and density. For more descriptions of the above, reference can be made to textbooks of medical physics or radiology.

As low energy X-rays do not normally contribute to the resolution of the method but are merely absorbed and scattered by the examination object, it is highly desirable to remove such X-rays from the X-ray beam prior to the beam contacting the examination object. These low energy X-rays are usually removed from the X-ray beam through the use of attenuators or filters.

Similar to the effects on examination objects, the attenuating ability of a filter is dependent upon the chemical composition, density and thickness of the material making up the filter. These relationships are represented by the following equation:

$$I = I_o e^{-\mu o x}$$

where I is the intensity of the radiation transmitted, $I_o$ is the intensity of the incident radiation, e is the base of natural logarithm, $\mu$ is the mass attenuation coefficient for the chemical element comprising the filter material, $\rho$ is the density of the filter material, and x is the thickness of the filter material.

Of the above factors, all except the attenuation co-efficient $\mu$ are independent of the frequency or energy of the incident radiation. The attenuation co-efficient varies with the energy of the incident radiation and is related to the atomic number of the chemical element of the filter material. These co-efficients have been experimentally determined and can be found in published tables, such as, for example, in UCRL 50174 by W.H. McMaster et al available from the National Technical Information Services, Springfield, Va., 22151.

For many years the most common means of filtration of X-rays used in medical and dental diagnosis has been through the use of aluminum filters. As an example, U.S. Pat. No. 2,225,940 discloses a wedge which is brought into the path of the X-ray beam. Additionally, U.S. Pat. No. 3,976,889 discloses the use of variable thicknesses of aluminum filters in dental x-rays to vary exposure levels. Almost all commercial x-ray units have some inherent filtration equivalent to about 1.0 to 1.5 mm of aluminum and those designed for medical and/or dental applications, utilize additional aluminum filtration.

The use of filters other than aluminum to filter low energy X-rays from an X-ray beam was the subject of U.S. Pat. No. 4,499,591, wherein a 127 micron thick yttrium filter was employed to filter the X-ray beam such that energies below 20 keV were eliminated from the beam. Also Heinrick and Schuster, "Reduction of Patient Dose by Filtration in Pediatric Fluoroscopy and Fluorography" *Ann. Radiol.* (1976) Vol. 19. pages 57–66, utilized a molybdenum filter of 100 microns to remove radiation below 20 keV from the X-ray beam.

Koedooder and Venema; Phys. Med. Biol. (1986) Vol , pages 585–600 describe a computer program which was developed to calculate possible filter materials for use with a range of kVP values and different image receptors. In their results they found that dose reductions of up to 40% were achievable, however, in most cases the loading of the X-ray tube was doubled resulting in reduced life of the X-ray tube.

In X-ray crystallography and diffraction studies, it is useful to have relatively homogeneous, monochromatic X-ray beams. Filter materials have been used for producing these relatively homogeneous X-ray beams by limiting the range of wavelengths of the X-ray beam. Thus, in U.S. Pat. No. 1,624,443, the use of a filter with a slightly lower atomic weight than the X-ray tube target has been found to produce an X-ray beam of suitable relative homogeneity for use in X-ray crystallography. This patent discloses, in a preferred embodiment, the use of a zirconium filter with a molybdenum target. The use of filters of the same material as the target has also been shown to result in an X-ray beam of relative homogeneity. U.S. Pat. No. 3,515,874 discloses the use of molybdenum for both a target and filter, particularly for mammography where it has been found that the energy level of the $K\alpha$ line emitted from a molybdenum target is ideal for resolution of tumors in mammography applications.

As seen from the above, it is appreciated that there is a risk involved when dealing with diagnostic X-rays due to the harmful effects of unnecessary radiation dosages. Therefore, there is a need for an efficient X-ray filter to reduce such dosages and which is compatible with existing X-ray equipment.

SUMMARY OF THE INVENTION

In accordance with the present invention, there is provided an X-ray filter which significantly reduces low energy radiation normally absorbed by the examination object without significantly affecting the desired high energy radiation. The filter is comprised of one or more materials containing as the major component elements selected from the group consisting of aluminum and elements having atomic numbers between 26 and 50 with the filter being selected to have X-ray filtering characteristics such that the intensity of X-rays having energies of 50 keV are reduced by about 8% to about 35% of the normal radiation levels.

In an aspect of the invention, the filter is encased in a thin plastic sheet which provides for protection of the filter during handling as well as some absorption of the secondary radiation emitted from the filter when it is contacted by the X-ray beam.

In another aspect of the invention, the filter is comprised of a metal foil constructed of a single elemental material, the elemental material being selected from the group consisting of niobium, copper, silver, tin, iron, nickel, zinc, zirconium, aluminum or molybdenum.

In yet another aspect of the invention, the filter is comprised of a niobium metal foil having a maximum thickness of about 75 microns or a niobium metal foil in combination with additional filtering foils.

As a result of the construction immediately above, the filter of the present invention filters energy from the X-ray beam which is usually absorbed by the examination object and does not contribute to the radiographic image of the examination object. This is achieved with little, if any, increased loading of the X-ray tube which would otherwise reduce its effective life. These and other features of the present invention will be appreciated from the detailed description of the preferred embodiments of the invention which follow.

BRIEF DESCRIPTION OF THE DRAWINGS

Preferred embodiments of the present invention are shown in the accompanying drawings in which.

DETAILED DESCRIPTION OF A PREFERRED EMBODIMENT OF THE INVENTION

Figure 2:
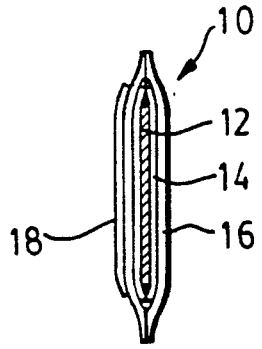
FIG. 2 is a sectional view of the filter of FIG. 1.
Figure 1:
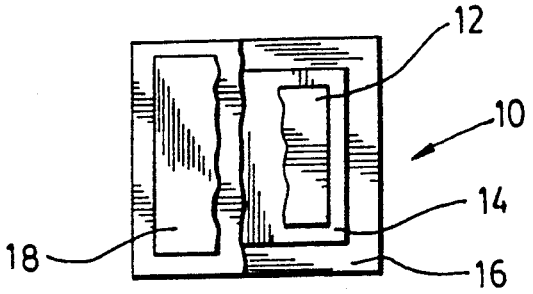
FIG. 1 shows a perspective view of a filter constructed in accordance with the present invention.

FIGS. 1 and 2 show a preferred embodiment of a filter of the present invention generally indicated at 10 comprising a metal foil 12 preferably constructed of an elemental material selected from the group consisting of niobium, copper, silver, tin, iron, nickel, zinc, zirconium or molybdenum. A particularly suitable construction is niobium in a thickness of up to about 75 microns, preferably about 40 to 60 microns, the most preferable thickness of the niobium metal foil being about 50 microns. This metal foil is encased in a coloured cardboard 14 wherein the colour can be used as an identifying means for the filter material and its thickness or the application in which the filter is to be utilized. Overlying and encasing the filter 12 and cardboard envelope 14 is a plastic covering 16 which serves as a protective covering to the filter. Additionally the combination of the cardboard 14 and the plastic covering 16 serves to absorb some of the secondary radiation emitted from the metal foil 12 when an X-ray beam contacts the metal foil and also reduces or eliminates the exposure of the metal foil to air, thereby reducing oxidation. Attached to one side of the filter 10 is a means for attaching the filter to the X-ray unit shown in the figures as a strip of double sided tape 18. The method of attaching the filter to an X-ray apparatus is discussed below.

FIG. 2 shows a cross-section of the filter 10 of FIG. 1 illustrating clearly the relationship between the metal foil 12, the cardboard envelope 14 and the plastic encasing material 16.

Figure 3:
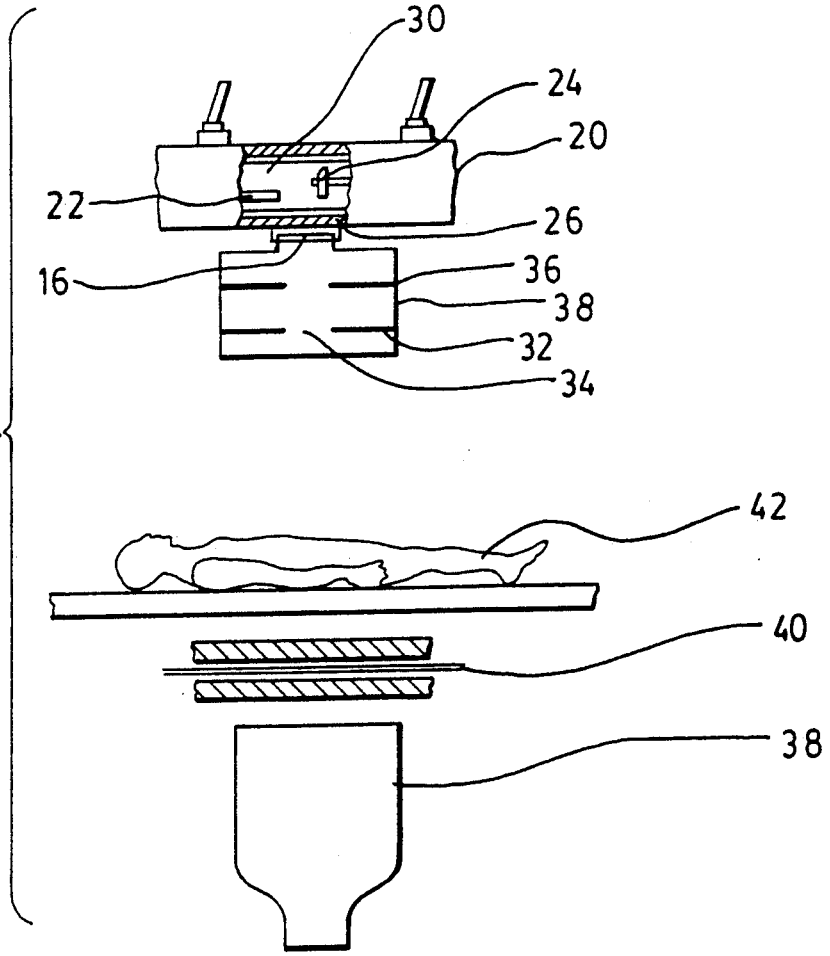
FIG. 3 is an elevational view of an X-ray diagnostic apparatus with the filter of the present invention in place.

FIG. 3 illustrates an X-ray generating apparatus 20 of typical lead based construction. The apparatus comprises an X-ray tube 30 with a cathode 22 and a rotating anode 24. Located within the cathode is a filament (not shown) which when heated by an electric current produces a cloud of electrons around the cathode. When high voltage from a generator (also not shown) is applied across the cathode 22 and the anode 24, the electrons in the cloud surrounding the cathode are accelerated as a beam towards the anode 24 which is comprised of a metallic material suitable as a target. Most commonly, the target is constructed of tungsten. When the electron beam strikes the target material, the energy of the electron beam is absorbed by the target material and results in the production of X-rays as explained hereinabove.

Owing to the construction of the anode 24, the X-ray beam is, to a large degree, focused and emitted from the X-ray apparatus 20 through a port 26. Port 26 usually comprises a window made of glass or plastic with an inherent filtration equivalent to about 0.5 mm of aluminum. In the typical applications, the X-ray beam emitted from the tube is focused through the use of a collimator 28. The purpose of collimator 28 is to direct the X-ray beam to cover only the area required in exposure of the examination object. This is achieved through adjustment of diaphrams 32 and 36, setting the collimator opening 34.

The X-ray apparatus also has inherent and added filtration (not shown), usually equivalent to 2.5 to 3.5 mm aluminum to remove, from the beam, very low energy X-rays which would be generally absorbed within the first few millimetres of the examination object. These very low energy X-rays do not contribute at all to the resolution of the radiograph, but rather merely contribute to increase the exposure dose of the examination object 42. The X-ray beams, once they pass through the examination object 42, are detected by a radiation detecting device as for example, an image intensifier 38 or directly on a radiographic film 40.

Filter 10 is shown attached in the apparatus between the port 26 of the tube 30 and the collimator 28. The filter is attached to the apparatus using the double sided tape 18, by sticking it onto either the port 26 of the tube 30 or the additional aluminum filtration. Alternatively, in those applications where this may not be possible, i.e. in some dental applications, it may be fixed in the opening of the collimator.

Figure 4:
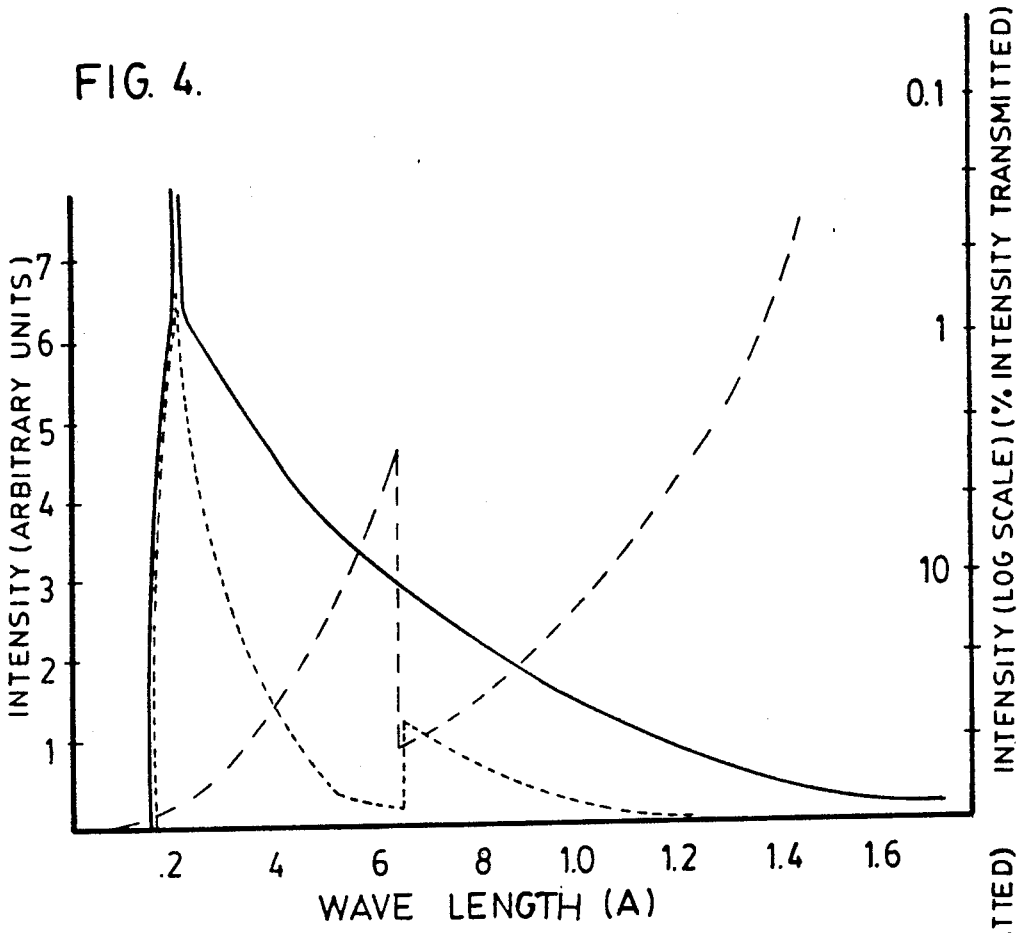
FIG. 4 is an x-ray wavelength spectrum of the typical apparatus of FIG. 3, showing both filtered and unfiltered spectrum.

FIG. 4 shows generally the X-ray wavelength spectrum emitted from an X-ray apparatus of FIG. 3. The apparatus with a tungsten target and 3.5 mm of aluminum equivalent filtration was operated at an accelerating voltage of 80 kVP thereby resulting in production of a continuous spectrum with a minimum wavelength of about 0.15 Å and the characteristic $K\alpha$ and $K\beta$ radiations of tungsten of about 0.21 Å and 0.18 Å respectively. The solid line shows the wavelength spectrum of the the normal radiation X-ray beam emitted from the apparatus prior to filtration by a 50 micron niobium filter. The long dash line is the attenuation properties of the 50 micron niobium filter. Niobium with an atomic number of 41 has a K absorption edge at about 0.65 Å and an $L_I$ absorption edge at about 4.58 Å (not shown on the figure). The short dash line shows the wavelength spectrum of X-ray beam after passing through the niobium filter. There is a marked decrease in the X-ray wavelengths from about 0.25 Å to just before the K absorption edge at 0.65 Å wherein only about 3% of the incident normal radiation is not absorbed by the filter. Thereafter the normal radiation of the X-ray beam is attenuated such that effectively all of the radiation is absorbed.

The choice of filter materials for the filters is dependent upon the requirements of the diagnostic technique as different techniques may require differing X-ray wavelength spectrums. For most medical and dental diagnostic techniques wherein the X-ray apparatus is operated at a peak voltage of between 55 keV and 110 keV, then any material whose major component is an element having an atomic number between 26 and 50 will be suitable for attenuating the X-rays beam. The elements having atomic numbers between 26 and 50 have K absorption edges between about 7 keV and 30 keV and hence in these kVP ranges will not exhibit appreciable K-edge phenomenon and hence will generally act as nonspecific filters. The choice of the filter materials is also dependent upon availability of the material in a form suitable for filter construction, preferably in a metal foil of a suitable thickness.

Owing to the characteristics of these materials, particularly for those elements available as metal foils, relatively thin filters are required, varying between generally on the order of 200 microns and less, the preferred materials resulting in X-ray filters having thicknesses on the order of 30 to 120 microns, the most preferred materials resulting in X-ray filters having thicknesses on the order of 30 to 70 microns. This is illustrated in the following table which lists the preferred metal foil filter materials and the preferred thickness.

| At. No | Element | Thick Range | Thick Preferred |
|---|---|---|---|
| 26 | Fe | 50–250 | 125 |
| 27 | Co | 50–225 | 125 |
| 28 | Ni | 50–200 | 100 |
| 29 | Cu | 50–180 | 120 |
| 30 | Zn | 60–205 | 125 |
| 38 | Sr | 100–305 | 205 |
| 39 | Y | 55–165 | 100 |
| 40 | Zr | 35–105 | 70 |
| 41 | Nb | 25–75 | 50 |
| 42 | Mo | 20–60 | 40 |
| 43 | Tc | 15–50 | 35 |
| 44 | Ru | 15–45 | 30 |
| 46 | Pd | 15–40 | 30 |
| 47 | Ag | 15–45 | 30 |
| 48 | Cd | 20–50 | 35 |
| 49 | In | 20–60 | 40 |
| 50 | Sn | 20–55 | 35 |

Those elements having atomic numbers between 26 and 50 which are not available as metal foils may be utilized by alloying them with one of the other materials. Particularly useful for alloying purposes is aluminum. Filters constructed in accordance with the present invention are easily adaptable to existing X-ray installations, thus resulting in reduced radiation exposure to the patient without significant increased cost. The filters also have the added benefit of reducing incident scattered radiation from the X-ray source, thereby reducing the levels of radiation to which operators of such equipment may be exposed.

If it is desirous to remove from the X-ray beam, all radiation having energy near the K absorption edge of niobium without appreciably increasing the attenuation of the beam in the diagnostically important region (generally from about 0.15 Å to about 0.4 Å), then a combination filter can be utilized. The combination filter will contain one or more materials containing more than one element selected from the group consisting of aluminum and elements having atomic numbers between 26 and 50. The combination filter can be constructed by layering individual metal foils or by alloying the materials into a single foil. The selection of the materials and the elements comprising the materials will be dependent upon the desired spectrum of the X-ray beam which in turn will be dependent upon the particular application.

Figure 5:
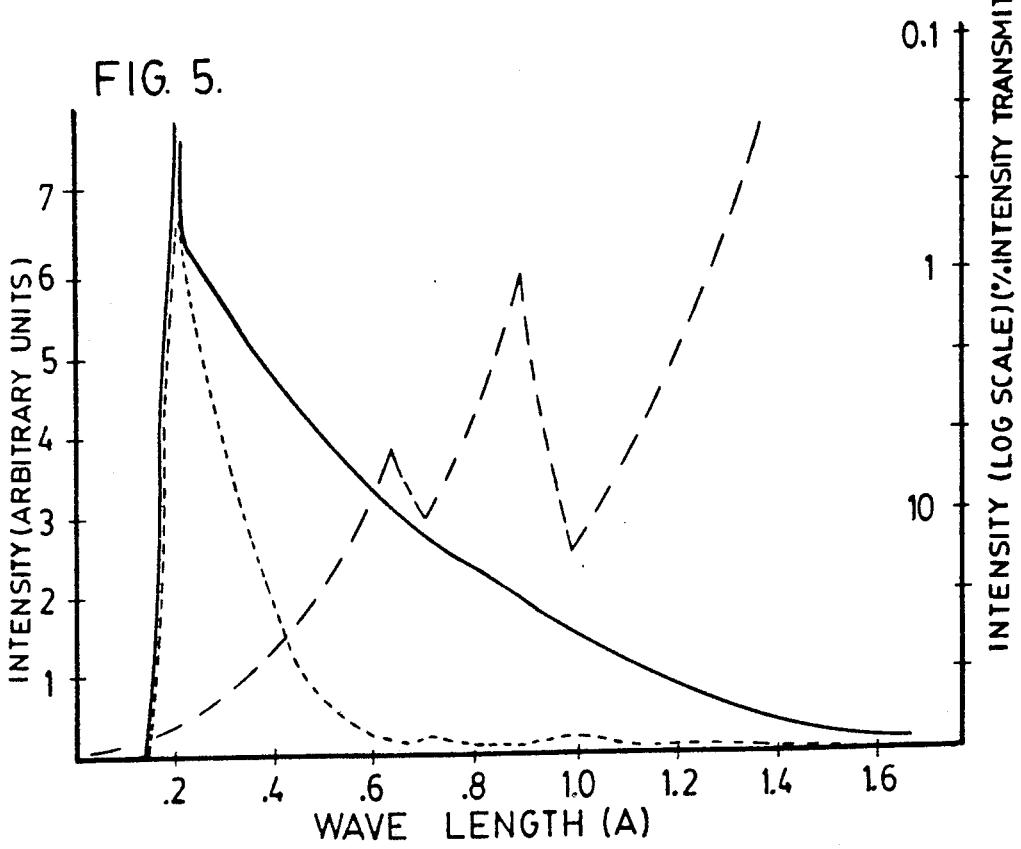
FIG. 5 is an X-ray wavelength spectrum of the apparatus of FIG. 3, showing the unfiltered and the filtered spectrum wherein a filter of a second embodiment of the present invention has been utilized.

As shown in FIG. 5 a combination filter of 25 microns of niobium and 50 microns of selenium is utilized.

The keys to the curves are the same as in FIG. 4 where the solid line is the unfiltered spectrum, the long dash line is the attenuation profile of the combination filter and the short dash line is the filtered spectrum. As is clearly shown, by employing selenium with a K absorption edge of about 0.98 Å, in combination with niobium, substantially all of the X-rays with wavelengths greater than about 0.6 Å are removed from the X-ray beam by the combination filter.

Thus, in the example shown in FIG. 5, the combination of niobium and selenium is particularly useful for applications where it is desirous to have an X-ray beam with wavelengths less than about 0.4 Å. If a harder beam is desired, i.e. one where the wavelengths are less than 0.3 Å or 0.2 Å, then the filter material would be chosen to remove X-rays with wavelengths longer than this. For example, tin with a K absorption edge at about 0.42 Å or indium with a K absorption edge at about 0.44 Å or silver with K absorption edge at about 0.48 Å would be useful. The above or other materials similar in attenuation properties would be used in combination with one or more materials having K absorption edges in the region of about 0.6 Å to 1.0 Å as for example materials from technetium to germanium in the periodic table.

The preferred thickness of the selected materials is dependent upon the density and attenuation co-efficients as discussed above. Generally the total thickness of the filter should be chosen such that the product obtained by multiplying together the thickness, the density and nm The use of a filter of the present invention will be illustrated further in the following examples:

EXAMPLE I

A 50 micron niobium filter encased in plastic was placed at the face of the collimator of a 3 phase 6 pulse unit with a total filtration of 3.5 mm. aluminum equivalent. Entrance doses were measured using a Victoreen exposure meter. A series of radiographs were taken of phantoms with and without the niobium filter. In order to achieve identical optical density in the radiographs the exposure for the filtered radiographs was increased slightly by 8 to 10%. The dose reduction values have been corrected for the slight increase in exposure.

TABLE I

| kV RANGE (kVP) | MEASURED ENTRANCE DOSE WITHOUT TEST FILTER | WITH TEST FILTER | % DOSE REDUCTION |
|---|---|---|---|
| 40 | .9 mr/mas | .22 mr/mas | 75% |
| 50 | 2.0 | .55 | 72 |
| 60 | 3.4 | 1.21 | 64 |
| 70 | 5.0 | 2.1 | 58 |
| 80 | 6.7 | 3.1 | 54 |

TABLE I shows a significant reduction in entrance dose between measurements taken with and without the niobium filter. This dose reduction is most marked for the lower kVP.

EXAMPLE II

This experiment was carried out using a General Electric Three Phase Generator and an automatic beam limiting device with an inherent filtration of 1.5 mm equivalent of aluminum at 150 kVP. The radiation detection device used was a Rad Check Plus, Model No. 06-526 The added filtration was 2.0 mm of aluminum making a total filtration of 3.5 mm of aluminum equivalent. Since the majority of X-ray examinations are carried out between 75 to 100 kVP, the generator was used at the following settings; mA—200; Time—0.35 Seconds; kVP—80.

A half value layer experiment was carried out, as well as a comparison of radiation dose obtained under;

(a) Normal operation—with only the 3.5 mm aluminum-/equivalent between source and the detector (b) exactly as in item (a), but with 100 microns of Yttrium added at the source in the field.

(c) Exactly as in item (a), but with 50 microns of Niobium added at the source in the field.

(d) Exactly as in item (a), but with 25 microns of Niobium added at the source in the field.

| OPERATION | ADDITIONAL FILTRATION | mR DOSE | % DOSE REDUCTION (COMPARED TO A) |
|---|---|---|---|
| (A) NORMAL OPERATION | | | |
| | 0 | 262 | |
| | 1 mm | 210 | |
| | 2 mm | 176 | |
| | 3 mm | 148 | |
| | 4 mm | 124 | |
| | 5 mm | 107 | |
| HALF VALUE LAYER = 3.7 mm Al | | | |
| (B) ADDITION OF 100 MICRONS OF YTTRIUM TO A | | | |
| | 0 | 149 | 44 |
| | 1 mm | 128 | 39 |
| | 2 mm | 112 | 37 |
| | 3 mm | 95 | 36 |
| | 4 mm | 83 | 33 |
| HALF VALUE LAYER = 4.85 mm Al | | | |
| (C) ADDITION OF 50 MICRONS OF NIOBIUM TO A | | | |
| | 0 | 138 | 48 |
| | 1 mm | 118 | 44 |
| | 2 mm | 99 | 44 |
| | 3 mm | 83 | 44 |
| | 4 mm | 72 | 42 |
| | 5 mm | 64 | 40 |
| HALF VALUE LAYER = 4.35 mm Al | | | |
| (D) ADDITION OF 25 MICRONS OF NIOBIUM TO A | | | |
| | 0 | 175 | 34 |
| | 1 mm | 148 | 30 |
| | 2 mm | 125 | 29 |
| | 3 mm | 107 | 28 |
| | 4 mm | 91 | 27 |
| | 5 mm | 79 | 26 |
| HALF VALUE LAYER = 4.25 mm Al | | | |

EXAMPLE III

Tests were conducted utilizing water phantoms of 5 cm, 10 cm, 15 cm, and 20 cm in depth. A step wedge was placed in the water to provide a measurable optical density (O.D.). A Siemens Tridoros Optimatic 800 generator was used for testing using the 0.6 focal spot size. Testing was done using a Keithly 35055 digital dosimeter at 115 cm FFD. The HVL measured before testing was 3.8 mm Al at 80 kV. A 50 micron niobium filter added to the 3.8 mm Al outside the collimator window. The results are as follows:

| PHANTOM | ADDITIONAL FILTRATION | EXPOSURE | TUBE VOLTAGE | DOSE | % DOSE REDUCTION |
|---|---|---|---|---|---|
| 5 cm | | 10 mAs | 63 kV | 28.4 mR | |

-continued

| PHANTOM | ADDITIONAL FILTRATION | EXPOSURE | TUBE VOLTAGE | DOSE | % DOSE REDUCTION |
|---|---|---|---|---|---|
| 5 cm | 0.05 mm Nb | 10 mAs | 63 kV | 10.2 mR | 64% |
| 5 cm | 0.05 mm Nb | 12 mAs | 63 kV | 16 mR | 44% |
| 5 cm | 4 mm Al | 10 mAs | 63 kV | 10.2 mR | 64% |
| 10 cm | | 20 mAs | 77 kV | 94 mR | |
| 10 cm | 0.05 mm Nb | 20 mAs | 77 kV | 50 mR | 47% |
| 10 cm | 0.05 mm Nb | 25 mAs | 77 kV | 73 mR | 22% |
| 10 cm | 3 mm Al | 20 mAs | 77 kV | 51 mR | 46% |
| 15 cm | | 32 mAs | 96 kV | 283 mR | |
| 15 cm | 0.05 mm Nb | 32 mAs | 96 kV | 170 mR | 40% |
| 15 cm | 0.05 mm Nb | 40 mAs | 96 kV | 215 mR | 24% |
| 15 cm | 3 mm Al | 50 mAs | 96 kV | 172 mR | 39% |
| 20 cm | | 50 mAs | 117 kV | 715 mR | |
| 20 cm | 0.05 mm Nb | 50 mAs | 117 kV | 453 mR | 37% |
| 20 cm | 0.05 mm Nb | 64 mAs | 117 kV | 569 mR | 20% |
| 20 cm | 3 mm Al | 50 mAs | 117 kV | 460 mR | 36% |

EXAMPLE IV

A series of spine and abdomen radiographs were taken under conditions shown in the following table. Measurement of dose was with a Capintec Dosimeter.

| PROJECTION | FFD | kVP | mA | TIME | UNFILTERED DOSE | FILTERED DOSE | % DOSE REDUCTION |
|---|---|---|---|---|---|---|---|
| CERVICAL SPINE | 40 | 70 | 100 | .1 | 31 | 7 | 78 |
| LATERAL LUMBAR SPINE | 40 | 90 | 300 | .2 | 556 | 264 | 54 |
| FULL SPINE | 72 | 90 | 300 | .2 | 110 | 50 | 55 |
| ABDOMEN | 72 | 90 | 300 | .2 | 110 | 50 | 55. |

The films taken with the niobium filter were judged by an experienced radiologist and determined to have greater detail than the unfiltered films.

EXAMPLE V

Tests were run using a WEBER Dental x-ray unit at 70 kVP and 10 mA with the 50 micron niobium filter. It was found that to achieve equivalent contrast and film quality with the niobium filter, exposure times were increased 1.5 to 2 times the exposure for the aluminum filter alone. In normal operation with the aluminum filter, exposure times are generally 0.2 to 0.3 seconds, with the addition of the niobium filter they are 0.3 to 0.5 seconds. Dose reductions are shown in the following table:

| FILTER | EXPOSURE TIME | DOSE MR | % DOSE REDUCTION |
|---|---|---|---|
| Al | 0.2 | 116 | 69% |
| Nb | 0.2 | 36 | |
| Al | 0.2 | 116 | 50.9% |
| Nb | 0.3 | 57 | |
| Al | 0.2 | 116 | 37.9% |
| Nb | 0.4 | 72 | |
| Al | 0.3 | 171 | 66.7% |
| Nb | 0.3 | 57 | |
| Al | 0.3 | 171 | 57.9% |
| Nb | 0.4 | 72 | |
| Al | 0.3 | 171 | 50.3% |
| Nb | 0.5 | 85 | |
| Al | 0.3 | 171 | 30.4% |
| Nb | 0.6 | 102 | |

Thus, at ordinary operating situations, the 50 micron Nb filter results in 30 to 50% dose reductions to the patient.

Although various preferred embodiments of the present invention have been described herein in detail, it will be appreciated by those skilled in the art, that variations may be make thereto without departing from the spirit of the invention or the scope of the appended claims.

We claim:

1. An x-ray apparatus for medical or dental diagnosis comprising an x-ray source operatable at a peak voltage of between 55 kev and about 110 kev for investigation of an examination object subjected to x-ray beams from the source, said source comprising an x-ray generating device having a port for passage of the x-ray beams therethrough, a focusing device for focusing the x-ray beams from the x-ray generating device and a filter positively secured to said x-ray generating device directly over said port, said filter having a lightweight flexible construction including a filter material containing as a major component elements selected from the group consisting of aluminum and elements having atomic numbers between 26 and 50 and a filter material support including a sealed casing around said filter material.

2. An x-ray apparatus as claimed in claim 1, wherein said filter includes securing means securing said filter directly to said x-ray generating device directly over said port, wherein said securing means comprises double sided sticky tape between said filter and said x-ray generating device.

3. A filter for use in an existing x-ray apparatus for medical or dental diagnosis without modification to the apparatus where the apparatus comprises an x-ray source operating at a peak voltage of between about 55 kev and about 110 kev for investigation of an examination object subjected to x-ray beams from the source and an x-ray beam focusing device attached to the x-ray source, said filter having a flexible construction comprising a filter material containing as a major component elements selected from the group consisting of aluminum and elements having atomic numbers between 26 and 50 and a flexible filter material support including a flexible casing in which said filter material is sealed.

4. A filter as claimed in claim 3, wherein said filter material support includes a transparent plastic casing in which said filter material is sealed and identifying means internally of said plastic casing for identifying characteristics of the filter material used in said filter.

5. A filter as claimed in claim 3, including securing means for securing said filter directly to said x-ray source.

6. A filter as claimed in claim 5, wherein said securing means comprises double sided sticky tape provided to the outside of said plastic casing of said filter material support.

* * * * *